US008020321B2

(12) United States Patent
Matthews et al.

(10) Patent No.: US 8,020,321 B2
(45) Date of Patent: Sep. 20, 2011

(54) SNOWSHOE FOOTBED PIVOT SYSTEM

(75) Inventors: Gregory Vinton Matthews, San Francisco, CA (US); Francis E. Mahoney, Barre, VT (US)

(73) Assignee: K-2 Corporation, Seattle, WA (US)

( * ) Notice: Subject to any disclaimer, the term of this patent is extended or adjusted under 35 U.S.C. 154(b) by 1227 days.

(21) Appl. No.: 11/639,394

(22) Filed: Dec. 13, 2006

(65) Prior Publication Data

US 2008/0141564 A1 Jun. 19, 2008

(51) Int. Cl.
*A43B 5/04* (2006.01)
*A43B 5/16* (2006.01)

(52) U.S. Cl. ..... 36/122; 36/124; 36/125

(58) Field of Classification Search ..... 36/122–125, 36/7.6, 7.7
See application file for complete search history.

(56) References Cited

U.S. PATENT DOCUMENTS

| | | | | |
|---|---|---|---|---|
| 3,802,100 | A * | 4/1974 | Prater | 36/124 |
| 4,161,071 | A * | 7/1979 | Maul | 36/125 |
| 5,517,772 | A | 5/1996 | Anderson | |
| 5,531,035 | A * | 7/1996 | Forrest | 36/125 |
| 5,659,981 | A | 8/1997 | Liautaud | |
| 5,829,173 | A * | 11/1998 | Svetlik et al. | 36/124 |
| 6,112,436 | A * | 9/2000 | Quellais | 36/124 |
| 6,178,666 | B1 * | 1/2001 | Kiniry et al. | 36/125 |
| 6,453,581 | B1 | 9/2002 | Kiniry et al. | |
| 6,684,534 | B2 * | 2/2004 | Dodge | 36/122 |
| 6,898,874 | B2 | 5/2005 | Emerson et al. | |

FOREIGN PATENT DOCUMENTS

| | | |
|---|---|---|
| EP | 0882478 | 12/1998 |

* cited by examiner

*Primary Examiner* — Jila M Mohandesi
*Assistant Examiner* — Melissa L Lalli
(74) *Attorney, Agent, or Firm* — Thomas M. Freiburger

(57) ABSTRACT

A snowshoe having a pivot axle for pitch rotation of the footbed platform relative to the snowshoe frame is supported from the frame in a manner that provides for significant lateral flexing, i.e. pivoting on the roll axis, to accommodate use of snowshoes on side hill terrain. Instead of a relatively rigid support from the snowshoe frame, the footbed platform is supported by left and right tension bands that are connected to the snowshoe frame and to left and right ends of the transverse pivot rod that provides pitch rotation. Preferably the connection to each end of the pivot rod is with a rotatable spindle over which the tension band engages, such rollers being connected at right angles to the two ends of the pivot rod. A rotation limiter can be included to limit free rotation of the binding in the pitch direction to a selected arc. The footbed support system can be employed on any type of snowshoe, whether a tubular frame, non-tubular frame or molded composite snowshoe.

30 Claims, 8 Drawing Sheets

SNOWSHOE FOOTBED PIVOT SYSTEM

BACKGROUND OF THE INVENTION

This invention concerns snowshoes, and in particular a snowshoe with a footbed platform having two degrees of rotational freedom, along a pitch axis and a roll axis.

U.S. Pat. No. 6,898,874 discloses a number of different forms of snowshoe footbed suspension to achieve two degrees of rotational freedom, along the pitch and roll axes, to facilitate tipping the foot relative to the snowshoe while taking steps and for stable walking on sidehill terrain. The numerous embodiments include footbeds suspended by spring-biased pairs of cables at left and right sides permitting roll and also pitch rotation. Other embodiments in the patent include a pivot shaft for pitch rotational movement, and with provision for spring-biased lateral rocking motion of the boot and footbed along the roll-axis, relative to the transversely mounted pitch pivot shaft. One form of suspension shown in the patent has a transverse horizontal pivot rod for pitch movement, with the rod supported on flexible, spring-biased arms that bend to provide return-biased roll rotation, i.e. tipping of the boot and footbed to left and right for sidehill tracking.

U.S. Pat. No. 6,453,581 shows a snowshoe with a pitch pivot rod on which the footbed rotates, the pivot rod having ends bent into hook shapes which are fastened to snowshoe frame rails by riveted loops of strap material.

SUMMARY OF THE INVENTION

A snowshoe of the current invention provides two degrees of rotational freedom for the user's boot relative to the snowshoe, through a simple and efficient suspension arrangement.

The snowshoe footbed is mounted on a pivot axle or pivot rod such as shown in some previous snowshoe constructions (see, e.g. U.S. Pat. No. 6,453,581 discussed above), the pivot rod providing for pitch rotation in the usual way. In this case, however, the pivot rod is not supported directly or firmly on the snowshoe frame or platform but is suspended by left and right tension bands that extend around the rails of a tubular frame, or around other structure of a non-tubular frame or composite snowshoe, to allow movement. These tension bands suspend the footbed via the pivot rod such that significant roll movement of the footbed relative to the frame is afforded for sidehill terrain, with the footbed being biased toward a return to the normal position. In a preferred embodiment the connection at each end of the pivot rod is with a rotatable spindle or roller member over which the tension band engages, with such rollers being connected at right angles to the two ends of the pivot rod.

In a preferred embodiment the tension bands are inelastic, with the freedom of movement and biasing being provided by a slight deformation of the snowshoe frame, which pulls inwardly when the footbed pivot rod is configured other than in a normal position substantially coplanar with the frame supports to which it is connected. Elastic bands could be used, if desired, in connection with a rigid frame or even with a somewhat resilient frame.

The tension bands preferably comprise closed loops formed of continuous loop material, although they could have a seam. In one preferred form these bands extend over a rounded member on the frame, such as a generally cylindrical tubular frame section, and also over a rounded member on the end of the pivot rod, i.e. the pivotal roller described above. The tension band may have a slot at the inner side to accommodate the pivot rod, for the preferred arrangement where the pivoting spindle is connected in T configuration at each end of the pivot rod. If the band comprises seamed batting, seams can be made using riveting and RF welding in combination, particularly for a band formed of urethane coated polyester webbing.

It is thus among the objects of the invention to support a snowshoe footbed for two degrees of rotational motion with a simple and efficient suspension system. These and other objects, advantages and features of the invention will be apparent from the following descriptions of preferred embodiments, considered along with the accompanying drawings.

DESCRIPTION OF PREFERRED EMBODIMENTS

Figure 1:
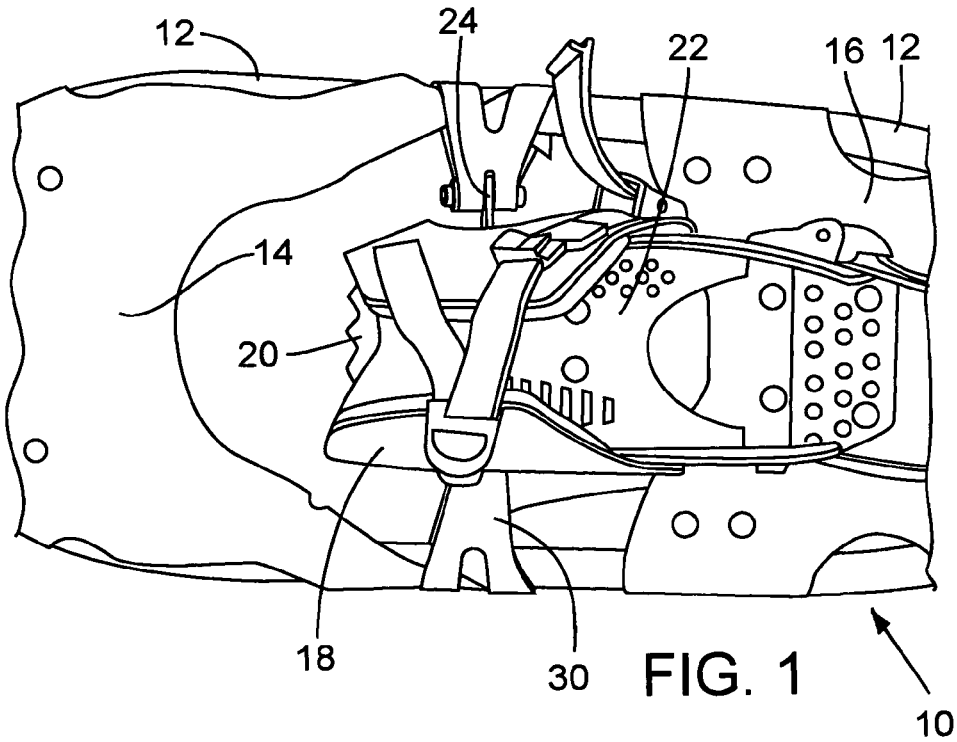
FIG. 1 is a plan view showing a portion of a snowshoe including the footbed suspension arrangement of the invention.

FIG. 1 shows in plan view a portion of a snowshoe 10 of the type formed of a peripheral frame 12 preferably formed of tubular metal such as aluminum. Cross sections other than circular can be employed. Also, the terms frame and frame member as used herein refer to any type of snowshoe, even a composite snowshoe not possessing a conventional frame. The snowshoe has a foredeck 14 and main deck 16 connected to and supported on the frame 12. A boot binding 18 is secured to a metal front cleat 20 better seen in FIG. 2, with a footbed 22 secured oh top of the cleat 20.

Figure 2:
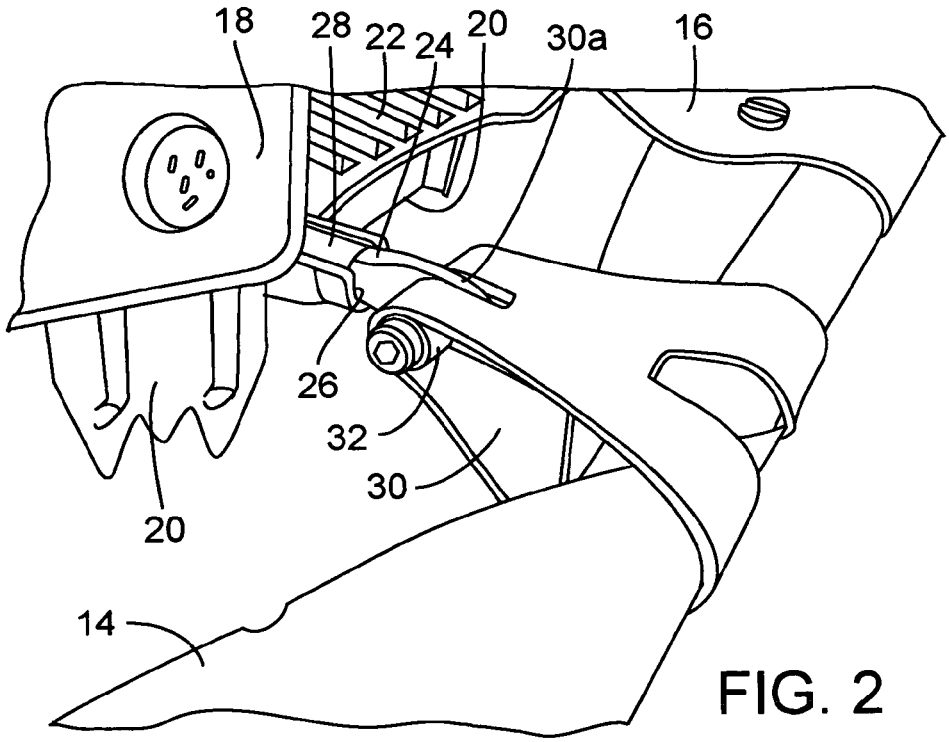
FIG. 2 is a perspective view showing a portion of the footbed suspension.

As shown in FIGS. 1 and 2, the snowshoe suspension includes a pivot axle or pivot rod 24 that is positioned for rotation within a groove or channel 26, generally U-shaped, extending transversely through the width of the front cleat 20. Preferably the metal of the front cleat is formed into this shape, to provide for rotation of the pivot rod 24 in the channel or groove 26. This is generally similar to the pivoting suspension arrangement shown in U.S. Pat. No. 6,453,581 referenced above, with a pivot shaft held from both ends, supported from the frame, and the front cleat providing a channel within which the pivot rod lies. This pivoting arrangement may include a plastic sleeve 28 over the pivot rod, providing relatively low-friction rotation of the cleat channel 26 relative to the pivot rod 24. The pivot axle 24 can be retained in the transverse channel 26 by the footbed 22 or by a rigid plate affixed directly below the footbed and against the plastic sleeve 28 over the pivot rod. The invention also includes embodiments wherein the pivot rod is not rotatable with respect to the cleat and footbed.

In the prior suspension arrangement of the '581 patent discussed above, virtually no roll movement of the boot/footbed was provided for relative to the snowshoe frame. The pitch pivot axle or rod had hook-shaped ends at both left and right, with each end secured by a somewhat flexible heavy plastic loop to the left and right rails of the tubular metal frame. The hook-shaped ends were positioned quite close to the snowshoe frame, sometimes only about 0.45" away from the inside edge of the frame. Some larger snowshoes of that design had more space between the frame and the hook, up to about 1.1" clearance for larger snowshoes, but still only about 1.6° roll deflection in either direction was afforded with a roll torque of 100 foot-pounds. The arrangement thus did not afford any useful roll of the boot, i.e. tilt left and right relative to the snowshoe frame within the transverse vertical plane, for sidehill tracking. This roll flexibility is partly a function of the spacing described, but also a function of tension, flexibility of components, and the manner is which the binding or axle is suspended from the bands.

The suspension of this invention provides for significant movement of the user's boot about the roll axis, such as for tracking on sidehill terrain, and also for a relatively cushioned suspension of the footbed from the snowshoe frame. Here, the pivot shaft 24 is suspended by tension bands 30 from the frame, engaging with pivoted rollers or spindles 32 that are mounted for rotation on a generally longitudinal axis, perpendicular to the length of the pivot rod itself. The tension bands preferably are substantially inelastic, and the snowshoe frame is arranged to deform springingly in an inward direction when tension increases in the bands due to walking on sidehill terrain and, to some extent, by deflecting the footbed downwardly under the weight of the user even on horizontal terrain. The distance of the pivoted rollers from the snowshoe frame is sufficient to allow the needed freedom of movement in the roll direction. That is, the distance is enough to allow the pivot rod and footbed platform to significantly deviate from the normal parallel/planar relationship with the snowshoe frame.

Figure 3:
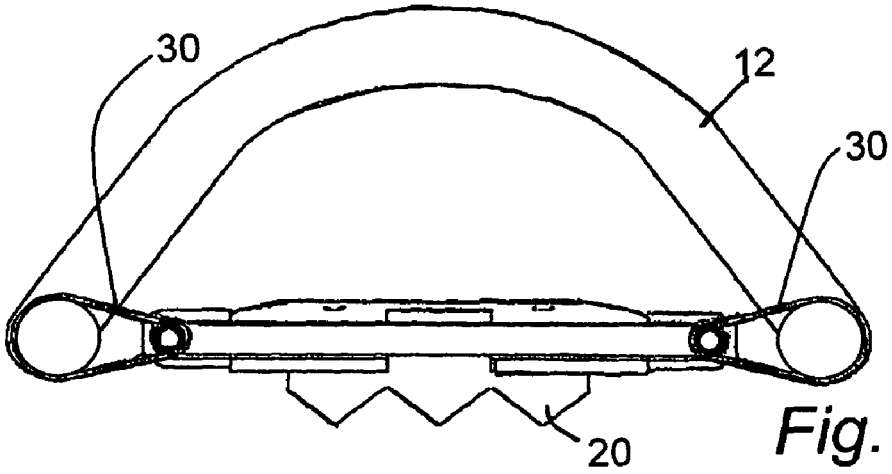
FIG. 3 is a transverse sectional view of the snowshoe showing the footbed in a normal and unstressed, undeflected position relative to the snowshoe frame.
Figure 4:
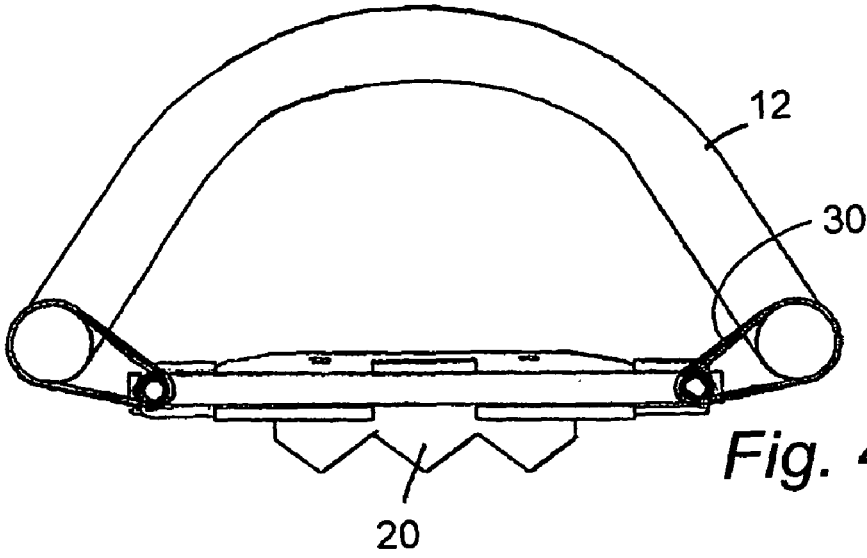
FIG. 4 is a view similar to FIG. 3, showing the footbed in a position with weight bearing on the footbed, deflected downwardly somewhat from the normal position of FIG. 3.
Figure 6:
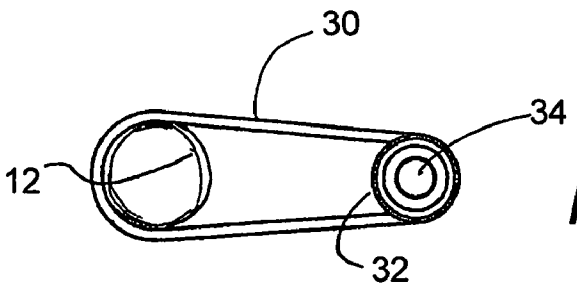
FIG. 6 is a detail view in transverse cross section, showing the suspension arrangement comprising a tension band connected to a pivot rod and to the snowshoe frame.
Figure 8:
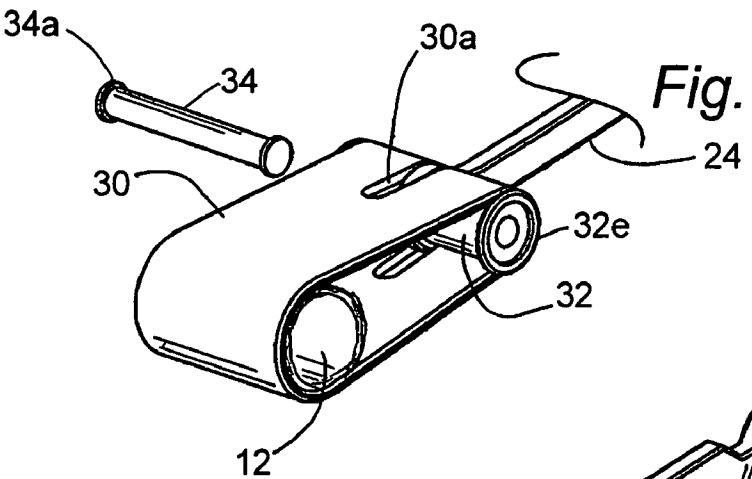
FIG. 8 is a view similar to FIG. 6 showing a detail of assembly.
Figure 7:
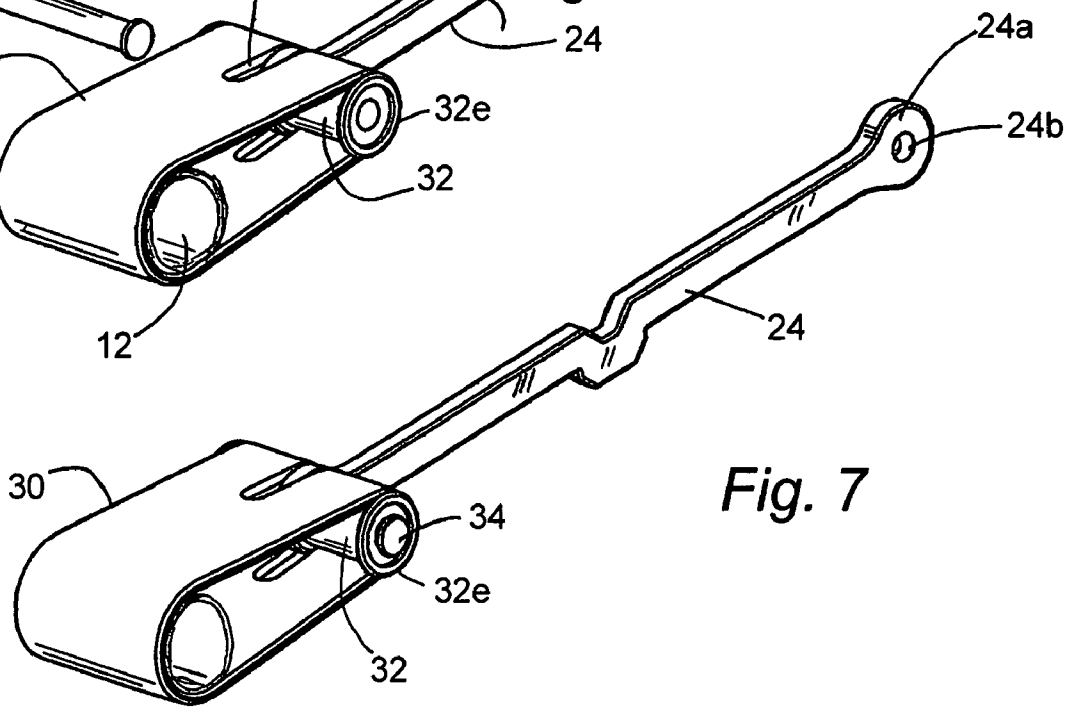
FIG. 7 is a perspective view schematically showing the tension band and pivot rod as connected to the snowshoe frame.

In the snowshoe binding suspension of the current invention, the tension bands 30 retain the footbed 22/cleat 20/binding 18 assembly from the snowshoe frame 12 with a higher tension than previously used and in an arrangement that connects with and interacts with the pivot rod 24 in a different way. As shown in the drawings, the pivot rod 24 has flattened ends 24*a*, the flats being in the generally vertical plane (or the entire rod can be of flat metal stock as described below). These flattened ends have holes 24*b* that support the pivoting spindle or roller 32, which can comprise two separate roller sections in tandem, on a pivot pin 34 passing through the hole 24*b*. "Roller" is intended to include a composite of two roller sections in tandem, as well as a single roller having a slit for engagement over the end of the pivot axle. The pin 34, preferably tightly received in the rod hole 24*b* for stability, can have a head 34*a* at one end and a suitable form of C clip or snap ring 34*b* at its other end, or another retention arrangement such as heads at both ends, one by deforming the end of the pin 34 after assembly. The spindle or roller 32 preferably is circular-cylindrical as shown in FIGS. 6-8, or it could take another shape as discussed below under some circumstances, but in either event it is mounted on the pin 34 and the end of the pivot shaft 24 in a manner providing for relatively low-friction rotation. The roller can have a flanged edge 32*e* for secure belt retention, as shown. It is preferred that the band 30 be fixed and not slidable around the snowshoe frame member 12 (which may not be round in cross section, and if so the spindle 32 should be cylindrical. The spindle on the left side would thus roll counter-clockwise as seen in FIG. 6 when the binding and cleat depress downwardly (from the FIG. 3 to the FIG. 4 position). If the band 30 is to slide around the frame 12 as the cleat/binding moves down, then the spindle can take a different shape, since the roller would then roll only to a limited extent, with the same side always directed toward the frame rail 12.

As shown in the drawings, the band 30 in this embodiment has a slit or slotted opening 30*a* for accommodating the flat pivot rod end 24*a*. Here the spindle or roller 32 comprises two separate roller sections in tandem that are separated by the flattened pivot rod end 24*a*.

Figure 5:
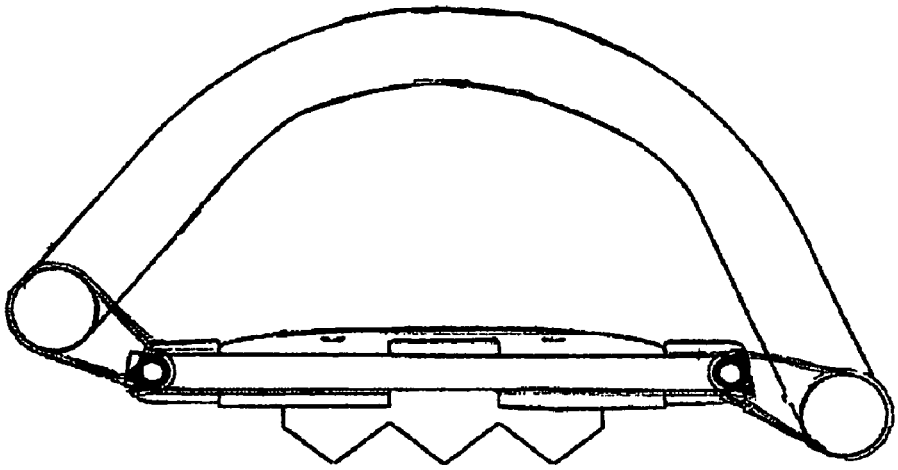
FIG. 5 is a view similar to FIG. 3 but showing the footbed platform in a position it would assume on sidehill terrain, relative to the snowshoe frame.

In the suspension arrangement of the invention the distance between the point of support at the end of the pivot rod and the snowshoe frame is greater than in the prior construction referred to above. For example, the distance from the inner edge of the tubular frame rail 12 to the pivot axis of the spindle 32 may be about ¾" to 1", although it could be even greater if desired. Measured another way, the distance of band free from contact with both the frame rail 12 and the roller 32 (from tangent of contact to tangent of contact in the embodiment shown) should be about 1" to 1.9", depending in part on snowshoe size, and more preferably in the range of about 1.2" to 1.9". This distance, along with the relatively free rotation and the band tension and flexibility of components, provides more flexibility in the orientation of the footbed relative to the frame, allowing the conditions shown in FIGS. 4 and 5 which were not possible with the prior art footbed suspension basically involving a bent wire rod forming a hook over which a band engaged to hold the rod ends to the snowshoe frame rails. The footbed suspension of the invention has been found to allow about 5.4° roll rotation (either direction) at 100 foot-pounds torque, whereas the prior design would only allow about 1.6° roll at the same torque.

The band 30 is substantially inelastic and can be formed of a strong urethane or rubbery plastic material such as a urethane coated polyester webbing, preferably continuous and without seams crossing the band, although it could be seamed if desired. Note that on each side the "band" could comprise two parallel bands separated by the pivot rod and 24*a*, (see FIGS. 9-11A) and the term "band", if not otherwise limited, is to be taken either way. As noted, the needed biasing or springiness is provided by the frame 12; when the footbed rocks left or right laterally, this pulls the frame tubing rails inwardly in a springing manner. Regardless of the type of snowshoe, frame members of some kind connect to the bands, and springing deflection is provided either by deformation of the frame members or by elasticity in the bands. However, in another embodiment the frame or frame portions holding the bands could be essentially rigid in spacing, with the bands having a prescribed amount of elasticity.

The bands 30 can comprise essentially pieces of belting material. Proper tension in the bands 30 is important to achieve proper support of the footbed. For an assembly in which the pivoted rollers or spindles 32 are spaced from the frame such that the free, non-contacting band distance is about 1½", the total pulling force in each band preferably is in the range of about 55 to 75 pounds, and it may be about 66 pounds. By total pulling force or tension force is meant the total force vector acting between the frame member and the pivot rod end. As seen particularly in FIGS. 1 and 2, the bands 30 in one embodiment can be tapered if desired, narrower toward the footbed/binding and wider at the engagement with the frame rail 12, although non-tapered banding can be used, or two parallel loops can comprise each band, as in FIG. 9 discussed below.

Figure 9:
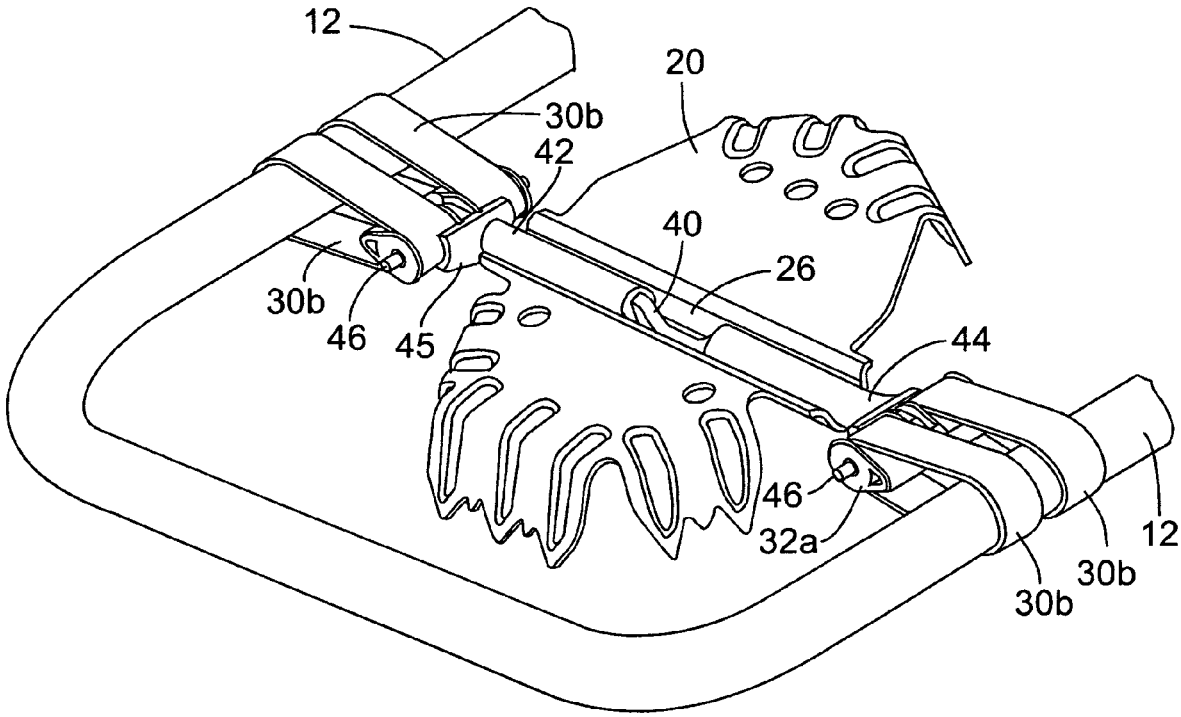
FIG. 9 is a perspective view showing a portion of a snowshoe frame with a modified form of the footbed suspension arrangement shown in FIGS. 1-8.
Figure 9A:
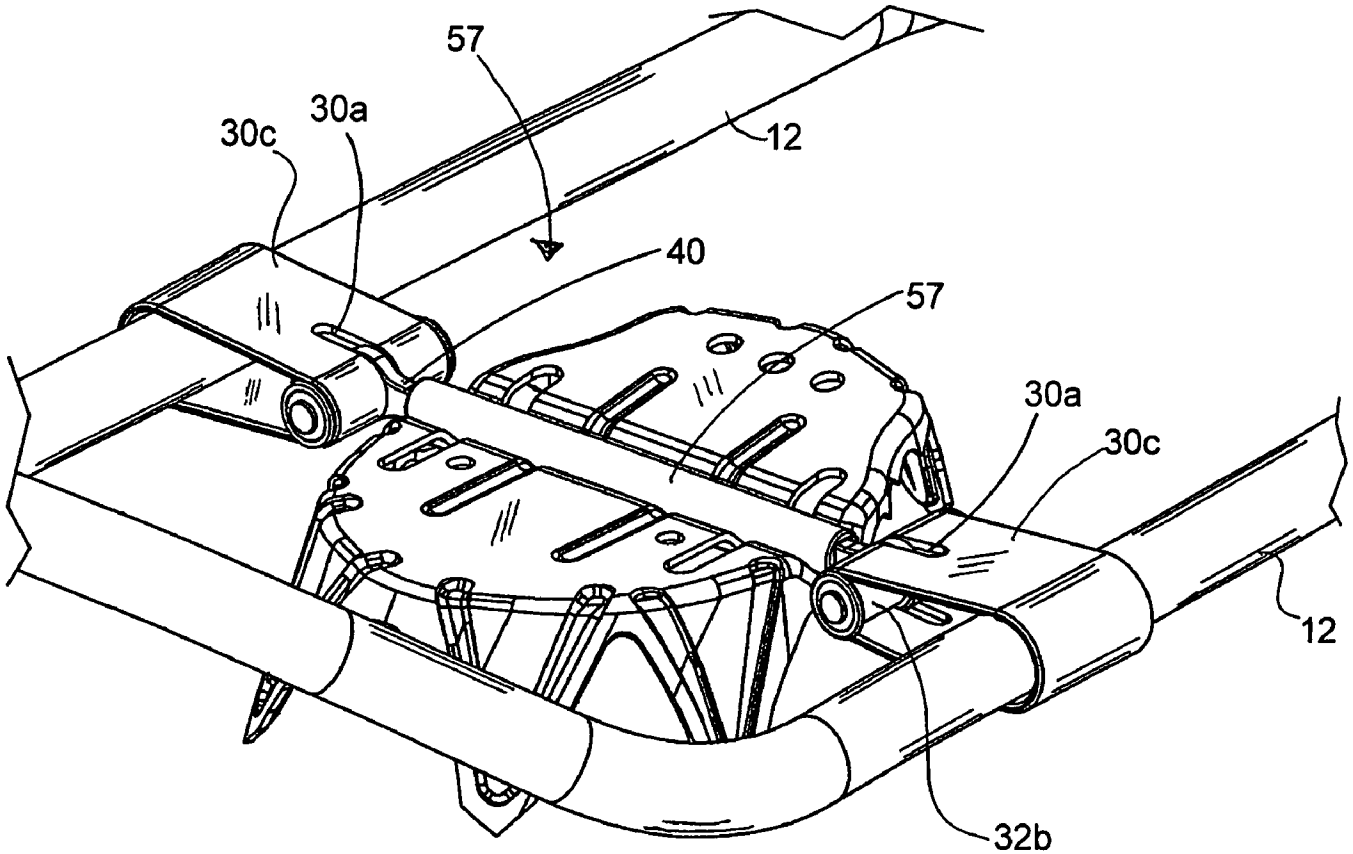
FIG. 9A is a view similar to FIG. 9 but with modifications.

FIGS. 9-11A show a snowshoe footbed suspension arrangement of the type shown in FIGS. 1-8, but with some variations, and in several different forms. In the embodiment of FIG. 9 the snowshoe frame 12 is engaged by a tension band that comprises a pair of parallel retainer loops 30*b* at each side. Each engages over a respective portion of a roller 32*a*, which preferably has dedicated indentations for each of the retainer loops. The rollers 32*a* are shown as cam-shaped, best adapted for a situation where the band loops 30*b* can slip on the frame 12. In this case the pivot bar comprises preferably a flat bar 40 (similar to that seen in FIG. 10), with greater strength in the weight-bearing direction of its cross section. This flat bar 40 is essentially covered by pivot sleeve parts 42 and 44 as seen in FIG. 9, each sleeve part having an end 45 which is preferably concave at its outer side and configured to engage close to the retainer loops 30*b* when assembled. A single integrated sleeve could be used, as noted below. A pivot pin 46 secures the roller 32*a* to the pivot bar or pivot axle 40, via a pivot pin opening in the end of the pivot bar (not seen in FIG. 9).

FIG. 9 shows that the rounded pivot sleeves 42, 44, which are slotted to fit down over the pivot bar 40, provide a surface to receive the rounded transverse channel 26 of the crampon or cleat 20.

Figure 10:
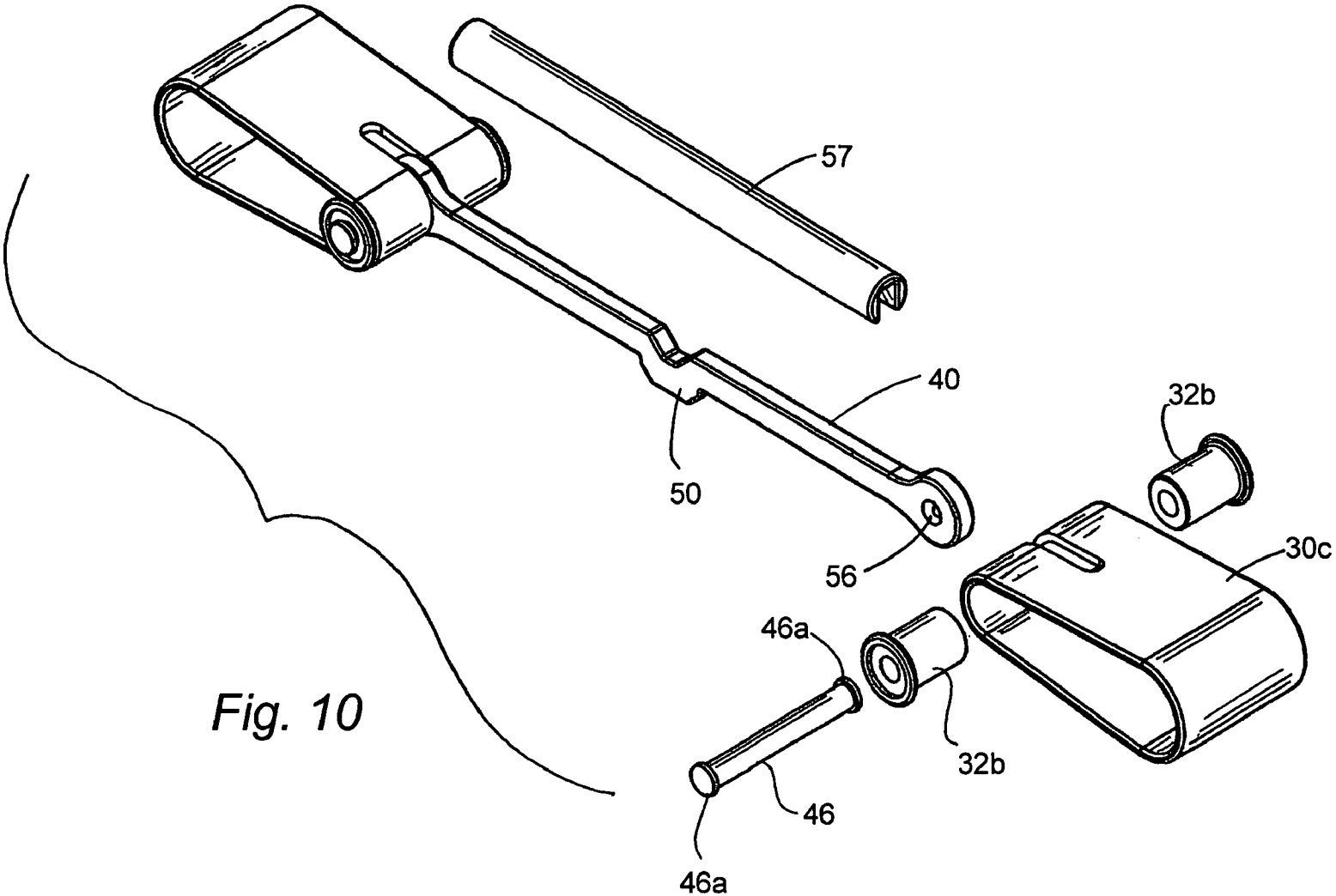
FIG. 10 is an exploded view in perspective showing components of the embodiment of FIG. 9A.
Figure 11:
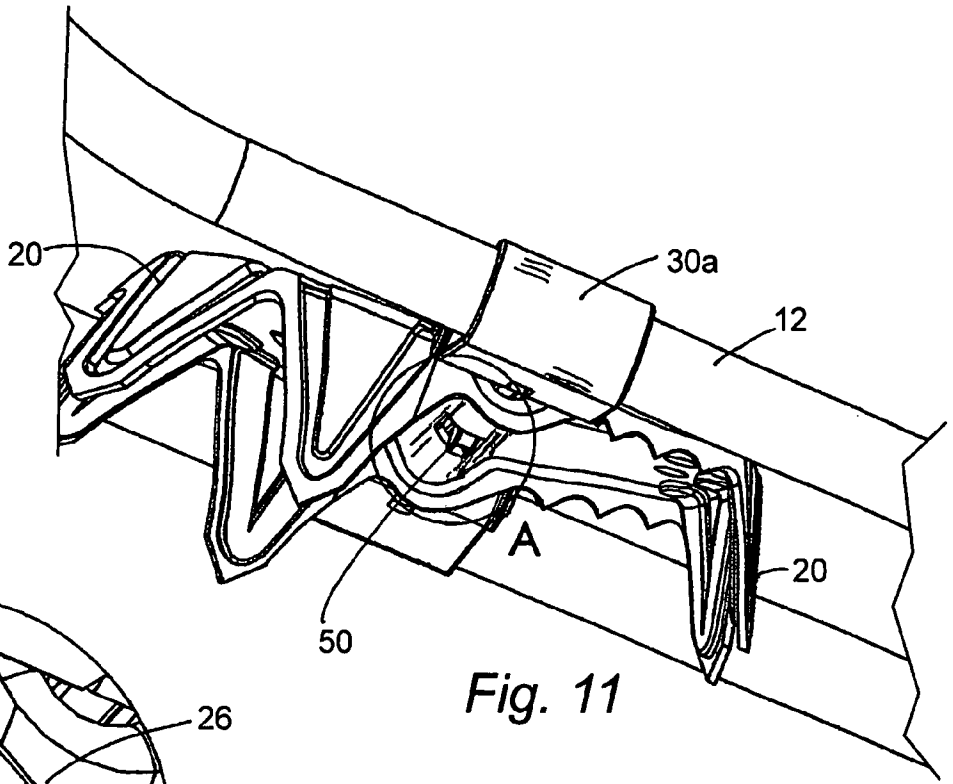
FIGS. 11 and 11A are a partial perspective view and an enlarged perspective view showing an aspect of the embodiment of FIG. 9A.
Figure 11A:
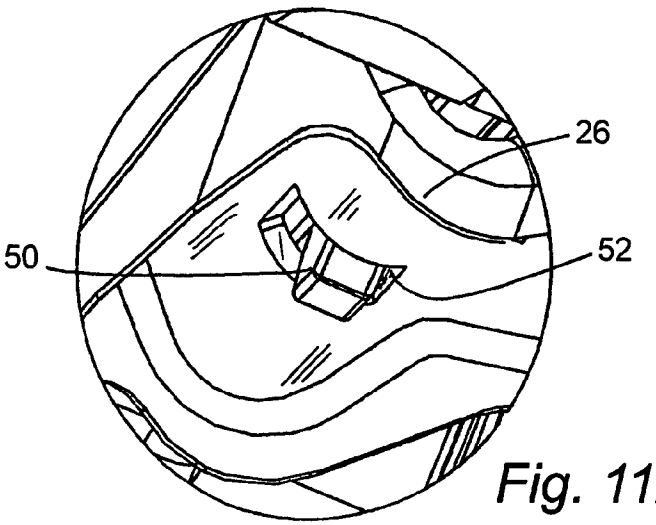

Another feature of this embodiment of the footbed suspension is a rotation limiter. In one preferred embodiment, limitation of the free rotation of the footbed/crampon assembly about the pivot bar is provided by a downwardly dipping center bend or extension 50 in the preferably flat pivot bar 40. This could be formed by a deformation in the bar or by a stem extending downward and integral with or welded to the remainder of the pivot bar (which could be round as well as flat). This dip or extension 50, shown in an otherwise modified embodiment in FIGS. 10, 11 and 11A, is positioned to extend down through an arcuate slot 52 in the transverse cleat channel 26 of the cleat 20. The two ends of the arcuate slot 52 define limit positions where the extension 50 will make a firm engagement with the cleat. In one preferred form of the invention the free rotation is through an arc of about 75°. Note that engagement at the end of the slot will not absolutely prevent further rotation of the cleat and binding relative to the snowshoe frame, but will translate torsion to the frame when rotation moves beyond a predetermined limit angle. Beyond this point, further rotation will tend to twist the roller pivot axis/pin 46 about the axis of the pivot axle or bar 40, thus drawing inward on the two sides of the frame 12 through the connection with the tension bands (retainer loops 30*b*), which are essentially non-elastic (but which can have some elasticity in a modified embodiment as noted above, particularly in combination with a more rigid frame). Thus, such rotation beyond the predetermined limit is against a fairly strong spring-like return force.

Other forms of rotation limitation can be used, with other forms of mechanical interaction between the cleat 20/footbed 22 assembly and the pivot axle, which could involve the ends of the pivot axle, i.e. the rollers.

FIGS. 9A through 11A show a somewhat modified form of footbed suspension system 55, primarily similar to that of FIG. 9 but with some changes. In this embodiment the tension bands 30*c* again each comprise single bands, one at each side of the snowshoe, again with cutout slots 30*a* to accommodate the ends of the pivot axle or bar 40. The pivot bar 40 is similar to that shown in FIG. 9, and is shown in better detail in the exploded view of FIG. 10. A roller pivot pin 46 is fitted snugly through a pin opening 56 at each end of the bar 40, and rollers 32*b*, two on each side, are fitted in low-friction engagement on the roller pivot pin 46. Although the pin 46 is shown with heads 46*a* formed on both ends, at least one of these is produced by deformation of the pin end after the rollers 32*b* have been assembled and the pin 46 is connected to the bar 40, with the tension band 30*c* in place. FIGS. 9 and 10 also show that a single axle sleeve 57 can be used in lieu of the two separate sleeves 42 and 44 shown in FIG. 9.

FIGS. 11 and 11A show, as described above, the rotation-limiting aspect of this embodiment, effected by the arcuate slot 52 in the cleat channel 26 and the tab or depending bend 50 on the pivot axle.

The snowshoe frame referred to above can take several different forms. It can be a bent or formed frame of tubular or square or other cross section, usually of metal, or it can be a composite snowshoe with some form of left and right side supports to receive the tension bands. The generally longitudinally extending members of the snowshoe frame, as referenced in the claims, can be exterior rails of a framed snowshoe frame or any other structure of another type of snowshoe, providing a relatively rigid structure for supporting the tension bands.

Although preferred for best operation, the rollers 32 could be eliminated and replaced by a simple "T" end on the pivot rod, this "T" end being substantially the same shape as the roller and engaging with the band. Most of the benefit of the above embodiments will be achieved, although the non-roller design will require slipping, at least at the "T" ends, so that friction will be higher and wear somewhat greater. Roll angle at 100 foot-pounds torque will be slightly less. The term T end is intended to include a fixed bar or a roller.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A snowshoe having a boot footbed that permits rotation of a user's boot along two axes of rotation during use of the snowshoe, comprising:

a snowshoe frame, a footbed platform with a connected front cleat and binding, to retain a user's boot on the footbed platform, a transverse pivot rod connected to the cleat for rotation of the cleat, footbed and binding on a pitch axis relative to the snowshoe frame, the footbed platform and cleat being positioned between two generally longitudinally extending members of the snowshoe frame, one at a left side of the pivot rod and one at a right side of the pivot rod, and with tension bands secured to the longitudinally extending members and to the pivot rod at the left and right sides, the bands being in tension such that the bands support the footbed platform and attached cleat and binding on the snowshoe frame, and at each end of the pivot rod, a roller extending perpendicular to the pivot rod on a generally longitudinal axis relative to the snowshoe, with the tension band engaged around the roller and the roller being in a rotation connection to the pivot rod, whereby the user's boot is afforded pitch rotation about a pitch axis defined by the transverse pivot rod to facilitate forward steps, and also roll rotation relative to the snowshoe frame, within a transverse vertical plane, to permit comfortable tracking on sidehill terrain.

2. The snowshoe of claim 1, wherein the tension bands are substantially inelastic.

3. The snowshoe of claim 1, wherein the roller at each end of the pivot rod is divided into two sections at forward and aft sides of the pivot rod end, the roller sections being mounted on a pin secured to the pivot rod.

4. The snowshoe of claim 3, wherein the pivot rod ends are generally flat with essentially planar vertical surfaces at fore and aft sides.

5. The snowshoe of claim 1, wherein the tension bands are formed of polyurethane coated polyester or polyethylene fiber webbing.

6. The snowshoe of claim 1, wherein each tension band comprises two separate and parallel loops.

7. The snowshoe of claim 1, wherein each roller is substantially cylindrical in shape.

8. The snowshoe of claim 1, wherein the snowshoe frame comprises a tubular metal rail.

9. The snowshoe of claim 1, wherein the front cleat and connected footbed and binding are rotatable relative to the pivot rod on said pitch axis.

10. The snowshoe of claim 1, wherein each tension band comprises a continuous loop without seams.

11. The snowshoe of claim 1, wherein each tension band has a seam, riveted and RF welded, the band comprising urethane coated polyester webbing.

12. The snowshoe of claim 1, wherein each tension band is under a total tension force in a range of about 55 to 75 pounds.

13. The snowshoe of claim 12, wherein each roller is spaced from the longitudinally extending member a distance such that the respective tension band has at least a one inch span not in contact with the roller or the longitudinally extending member, at both a top and bottom portion of the respective tension band.

14. The snowshoe of claim 1, wherein the pivot rod comprises a generally flat bar having a cross section deeper in a vertical direction than in a longitudinal horizontal direction.

15. The snowshoe of claim 14, including a generally cylindrical sleeve with a generally cylindrical outer surface over the pivot rod, and the generally cylindrical outer surface of the sleeve residing in a transverse channel of the cleat.

16. The snowshoe of claim 1, wherein the pivot rod includes a depending tab located generally centrally along its length, the depending tab extending through an arcuate slot of defined length in a transverse channel of the cleat to define a pitch rotation limiter via the ends of the arcuate slot, such that freely pivoting rotation of the cleat and binding relative to the frame is limited to the arc of motion of the tab within the arcuate slot.

17. A snowshoe having a frame and a footbed platform supported from the frame in a manner to afford roll rotation of a user's boot, that is movement in a transverse vertical plane, while using the snowshoe, comprising:

the footbed platform including a front cleat and a footbed above the front cleat, with a pivot rod extending transversely between the footbed and the front cleat and providing for pitch rotation of the footbed and front cleat relative to the snowshoe frame, at each end of the pivot rod, a roller oriented generally longitudinally relative to the snowshoe and journalled for rotation relative to the pivot rod along a generally longitudinal axis relative to the snowshoe, at each end of the pivot rod, a looped tension band extending around the respective roller and around a generally longitudinal frame member spaced laterally outwardly from the respective roller, each band being in tension so as to support the footbed platform from the snowshoe frame in such a way as to allow lateral flexing of the footbed carrying the user's boot relative to the snowshoe frame, generally along a roll axis of the snowshoe, as the footbed platform tips left or right relative to the snowshoe frame.

18. The snowshoe of claim 17, wherein each band is continuous and not seamed.

19. The snowshoe of claim 17, wherein each band is substantially inelastic, with lateral flexing being accommodated by deflection of the longitudinal frame members to which the bands are attached.

20. The snowshoe of claim 19, wherein the snowshoe frame comprises a tubular metal frame.

21. The snowshoe of claim 17, wherein each band has some elasticity.

22. The snowshoe of claim 17, wherein each band is formed of polyurethane coated polyester or polyethylene fiber webbing and has a seam secured together by riveting and RF welding.

23. The snowshoe of claim 17, wherein each roller comprises two tandem roller sections on fore and aft sides of the pivot rod end, each section with a hollow central bore extending in the longitudinal direction, and with a pin secured to the end of the pivot rod in a T configuration, the roller sections being rotatable on the pin.

24. The snowshoe of claim 23, wherein each tension band has a slotted opening through which the pivot rod passes.

25. The snowshoe of claim 17, wherein each roller is spaced from the longitudinal frame member a distance such that the respective tension band has at least a one inch span not in contact with the roller or the longitudinal frame member, at both a top and a bottom portion of the respective band.

26. The snowshoe of claim 17, wherein each tension band comprises two parallel and spaced apart loops.

27. The snowshoe of claim 17, wherein each tension band is under a total tension force in a range of about 55 to 75 pounds.

28. The snowshoe of claim 25, wherein said span not in contact is at least about 1.5 inches long.

29. The snowshoe of claim 17, further including means for establishing a limited arc of free rotation of the front cleat and footbed relative to the snowshoe frame.

30. The snowshoe of claim 17, wherein the roll rotation afforded under a load of 100 foot-pounds on the snowshoe footbed platform is at least about 5°.

* * * * *